United States Patent [19]

Bixler et al.

[11] 4,208,006

[45] Jun. 17, 1980

[54] MOLDED PULP TRAY FOR BEVERAGE AND FOOD

[75] Inventors: Kenneth D. Bixler, Huntington; Robert E. Ralphs, Katonah, both of N.Y.; Henry A. Lord, So. Portland, Me.; Richard F. Reifers, New Canaan, Conn.

[73] Assignee: Diamond International Corporation, New York, N.Y.

[21] Appl. No.: 15,694

[22] Filed: Mar. 27, 1979

[51] Int. Cl.[2] ..... B65D 3/24; B65D 1/00

[52] U.S. Cl. ..... 229/2.5 R; 229/15; 206/564

[58] Field of Search ..... 229/2.5 R, 15; 206/564

[56] References Cited

U.S. PATENT DOCUMENTS

| | | | |
|---|---|---|---|
| 2,766,919 | 10/1956 | Randall | 229/2.5 R |
| 2,776,772 | 1/1957 | Itoda | 229/2.5 R X |
| 3,432,026 | 3/1969 | O'Leary | 206/564 X |
| 3,542,280 | 11/1970 | Crabtree | 229/15 |
| 3,656,681 | 4/1972 | Goings | 206/564 X |
| 3,915,371 | 10/1975 | Crabtree | 229/15 |
| 3,942,671 | 3/1976 | Florian | 229/2.5 R X |

*Primary Examiner*—Davis T. Moorhead
*Attorney, Agent, or Firm*—Karl W. Flocks

[57] ABSTRACT

A tray of molded pulp or like material for carryout food and beverage comprising one or more pockets for receiving and firmly supporting any one of several different size beverage containers normally used in the carryout food trade, each of the pockets having a circular floor portion, a web portion extending for a full 360° around the circular floor portion in an area adjacent the circular floor portion and diverging in the upward direction, the web portion extending along a generally conic surface to an upper ridge, a plurality of circumferentially spaced apart tower-like members extending radially inwardly of the pocket from the web portion to firmly grip and support a beverage container which may be received in the pocket member but being too large in diameter to reach the circular floor portion, each of the tower-like members extending upwardly from the web portion at an area above the upper ridge of the web portion, each of the tower-like members including a pair of circumferentially spaced radially inwardly extending flanges having integral therewith at upper ends thereof a generally horizontal bridge, the pair of radially inwardly extending flanges and the bridge having radially inner edges which together with the web portion define an aperture facilitating stacking a tray having such pockets formed therein with like tray in nesting relationship, the radially inner edges of the flanges extending from upper ends thereof at the respective bridges toward the respective lower ends thereof at a steeper angle with the horizontal and closer to the vertical than the web portion whereby any beverage container received in the pocket will upon coming into contact with the radially inner edge of one of the flanges be maintained inwardly of the aperture defined thereby and above the circular floor portion to insure that any drippage or spillage from a beverage container will be retained within the floor portion within the enclosure provided by the web portion in the area adjacent the floor portion.

38 Claims, 41 Drawing Figures

MOLDED PULP TRAY FOR BEVERAGE AND FOOD

BACKGROUND OF THE INVENTION

1. Field of the Invention

The field of the invention disclosed and claimed herein is that which relates to disposable carry-out food trays of molded pulp or like material. More particularly, the field of the present invention relates to compartmented trays including separate compartments or pockets for food and for beverages. The most relevant art to be found with respect to the present invention would in applicant's opinion be found in Class 229, Subclass 15.

2. Description of the Prior Art

Exemplifying the most relevant prior art known to applicant is U.S. Pat. No. 3,915,371 (Crabtree). The Crabtree patent, while it relates to a molded pulp tray including different compartments and/or pockets for food and for beverages, like earlier developments in any art does not fulfill the needs of each and every one of the intermediate user of such trays. Without demeaning the prior art, applicant notes that the intermediate users of trays of the type in question, that is the fast-food industry, has consistently required trays of new design and construction to provide features not characteristic of trays available in the market.

The Carbtree patent is of interest in that it discloses various embodiments of a beverage containing tray of molded pulp. In one embodiment, Crabtree discloses a tray with a single pocket for a beverage and a compartment for food such as a sandwich. In a second embodiment, Crabtree discloses a tray with two pockets for beverage and one compartment for food. Crabtree also discloses an embodiment with multiple pockets for beverage only. Because of the many pockets and/or compartments formed in a molded pulp tray, such construction could and in many cases provide areas along which rupture would result if the tray is used for carrying food having a fair amount of weight. Chances of rupture are increased if the tray becomes wet from spilled liquids, in particular areas devoid of pulp accretion. Other structural characteristics of trays of this type are the result of functional demands, such as tilt-proof, spill-proof, ease of inserting and/or removing beverage containers.

SUMMARY OF THE INVENTION

Based upon considerations to be set forth hereinbelow and, in part, at least upon the considerations discussed above, applicant has conceived and developed the disclosed invention in order to provide a new and improved molded tray of pulp or like material for use in the fast-food industry, a tray in which a beverage may be safely carried therein without danger of tipping over or spilling.

It is another object of the present invention to provide a molded tray having one or more pockets in which beverage contained in any of several sizes used in the industry may be securely and/or safely carried with minimum chance of tipping over and/or spilling.

It is a further object of the present invention to provide a new and improved molded tray for use in carrying both food and beverage, where such tray may be nestably stacked with like trays for compactness in shipment and/or storage.

It is still another object of this invention to provide a new and improved nestable tray which will have a tendency to catch and collect any liquids which may splash over, spill, or drip from the beverage container.

A further object of this invention is to provide a molded pulp tray comprising beverage container pockets with new and improved container engaging structure which affords easier insertion and withdrawal of large size containers.

Still a further object of this invention is to provide a new and improved tray wherein even the relatively smaller size beverage container used in the fast-food industry will be retarded against tipping over when held in the disclosed tray.

It is yet another object of this invention to provide a new and improved molded pulp tray in which tendency of relatively heavy food held in a given compartment to cause flexing and weakening along areas separating compartments will be resisted and not succumb to torque thereat.

BRIEF DESCRIPTION OF THE DRAWINGS

In the accompanying drawings in which the preferred embodiments of the invention are illustrated.

DETAILED DESCRIPTION OF THE INVENTION

Figure 3:
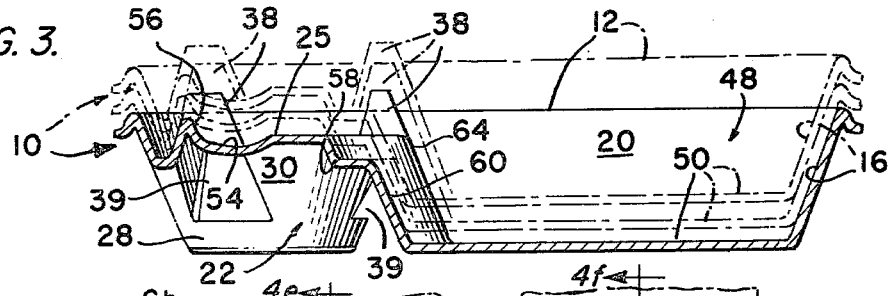
FIG. 3 is a sectional view taken along the plane 3—3 in FIG. 1 with several similar trays in phantom nestably stacked thereon.

Referring now in detail to the drawings, the invention will be readily understood in terms of the preferred embodiment illustrated in FIGS. 1-5 in which a tray 10 for carry-out food and beverage of molded pulp or like material is defined by an upper ridge 12 having first and second end wall portions 14,16 and first and second side wall portions 18,20 extending downwardly therefrom at a slight inclination inwardly toward the interior of the tray whereby the tray may be readily stacked in nested relationship with similar trays, as may be seen in FIG. 3. The tray 10 comprises one or more generally conical pocket members 22, which are adapted to receive and firmly support any one of several different size beverage containers C normally used in the carry-out food trade. The generally conical pocket members 22 are formed and disposed along a one end wall portion 14 and along one or the other of the side wall portions 18, 20. Each of the conical pocket members 22 has a circular floor portion 24 and a conic section 26 including a lower conic web surface portion 28 and a plurality of upper conic web surface portions 30. The lower conic surface portion 28 is integrally formed with and extends upwardly from the floor portion 24 for a full 360° in the immediate vicinity of the floor portion 24 whereby any beverage container C which may be received in the pocket member 22 in seated relationship on the floor portion 24 will be surrounded by the lower conic surface portion 28 and further whereby any drippage or spillage from the beverage container C received in the pocket member 22 will be retained on the floor portion 24 within the enclosure provided by the lower conic surface portion 28. The upper conic surface portions 30 are circumferentially spaced from each other and integral with the lower conic surface portion 28 and extend upwardly therefrom. Each of the upper conic surface portions 30 has circumferentially spaced inwardly extending radial webs 32,34 integral therewith on opposite sides thereof. The radial webs 32,34 extend inwardly of the pocket member 22 from the respective upper conic surface portion 30 and upwardly above the ridge 12. A generally horizontal bridge member 36 extending from one of the radial webs 32 to the next web 34 circumferentially spaced therefrom integrally joins the two webs 32,34 to form a tower-like member 38. The bridge member 36 together with the two radial webs 32,34 joined thereby, and the conic section 26 define one of a plurality of apertures 39 which facilitate nesting relationship of the tray 10 with similar trays 10, but will not permit passage of a cup C to be received and firmly held within the pocket member 22 beyond the theoretical conic surface of the upper and lower conic surface portions 30,28 if lowered to the level of the area of the aperture 39. Each of the bridge members 36 has a circumferentially extending radially inner edge 40 which is adapted to brace the side wall of a beverage container C intermediate the upper and lower ends thereof, and the radial webs 32,34 of each of the tower-like members have radially inner edges 42,44 of which at least one is adapted to firmly brace the side wall of a beverage container C.

Figure 4:
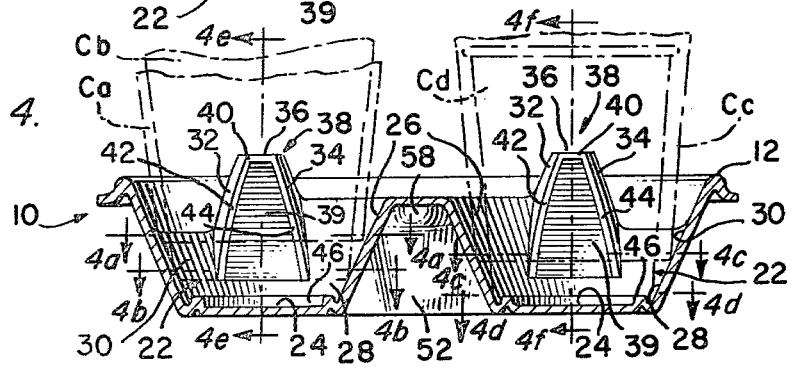
FIG. 4 is a sectional view taken along the plane 4—4 in FIG. 2.
Figure 4A:
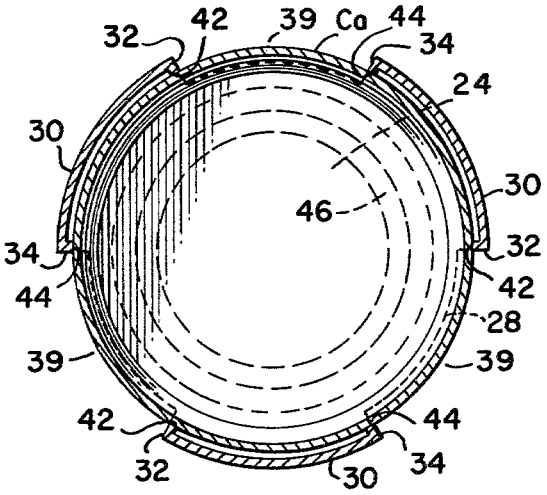
FIG. 4*a* is a horizontal sectional view taken along the plane 4*a*—4*a* in FIG. 4.
Figure 4B:
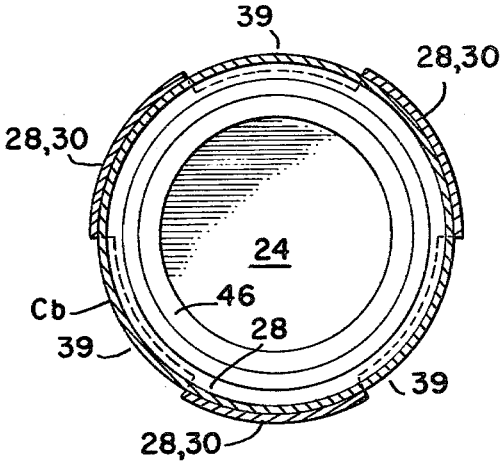
FIG. 4*b* is a horizontal sectional view taken along the plane 4*b*—4*b* in FIG. 4.
Figure 4C:
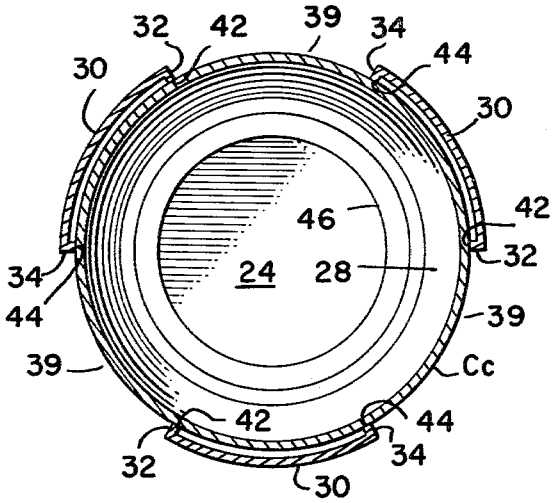
FIG. 4*c* is a horizontal sectional view taken along the plane 4*c*—4*c* in FIG. 4.
Figure 4D:
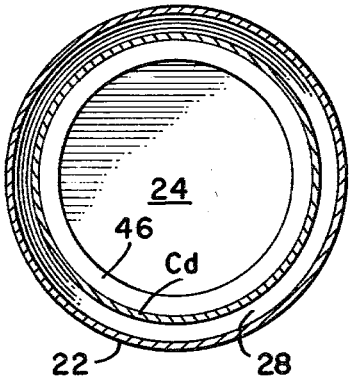
FIG. 4*d* is a horizontal sectional view taken along the plane 4*d*—4*d* in FIG. 4.
Figure 4E:
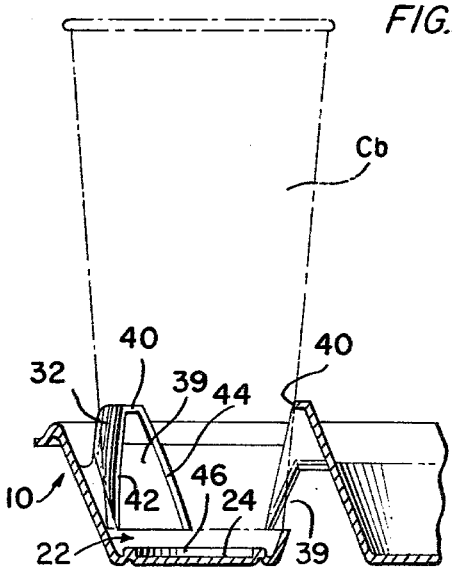
FIG. 4*e* is a vertical sectional view taken along the plane 4*e*—4*e* in FIG. 4.
Figure 4F:
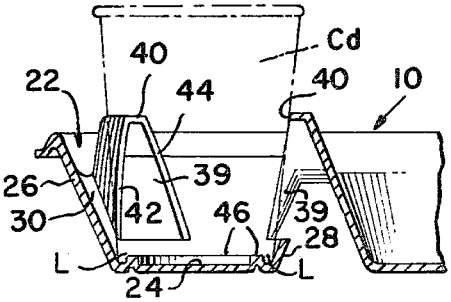
FIG. 4*f* is a vertical sectional view taken along the plane 4*f*—4*f* in FIG. 4.
Figure 5:
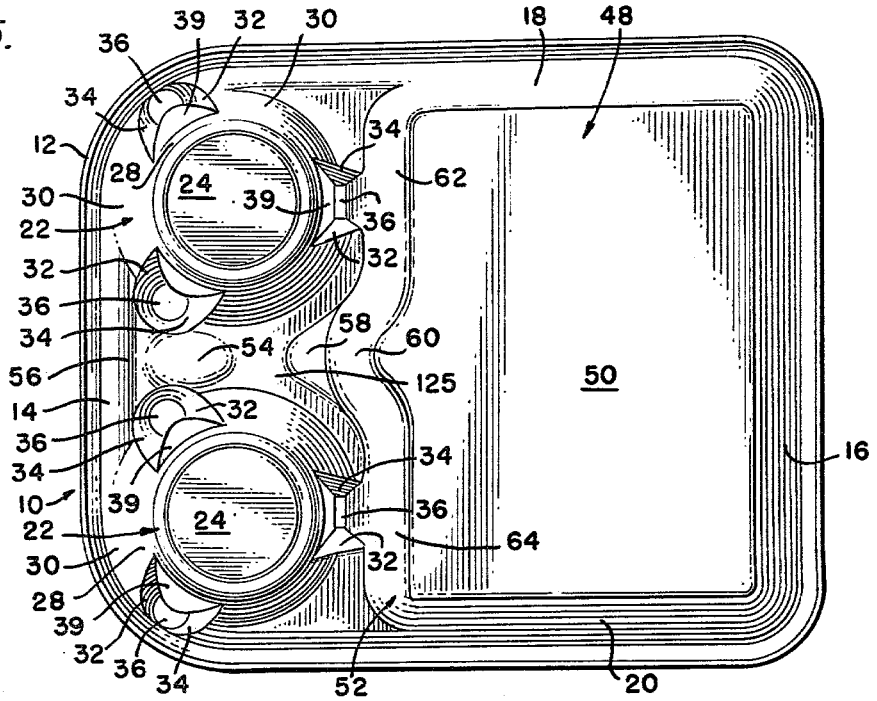
FIG. 5 is a bottom plan view of the tray of FIG. 1.
Figure 6:
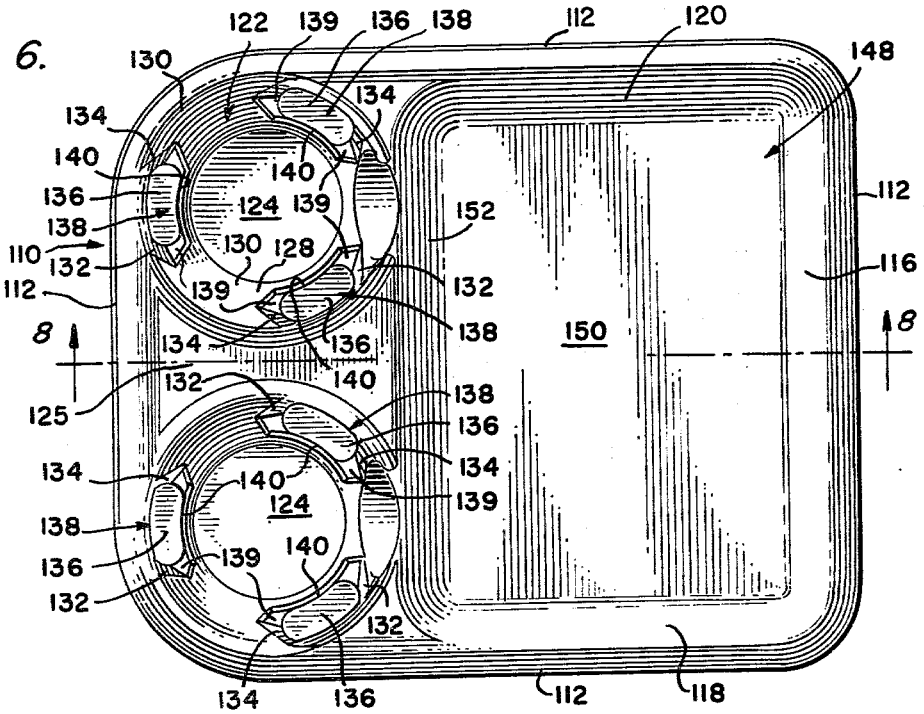
FIG. 6 is a top plan view of an alternative embodiment of the tray illustrated in FIG. 1.
Figure 7:
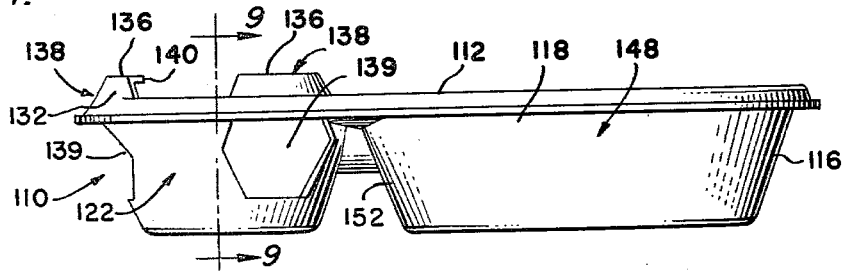
FIG. 7 is a side elevational view of the tray of FIG. 6.
Figure 8:
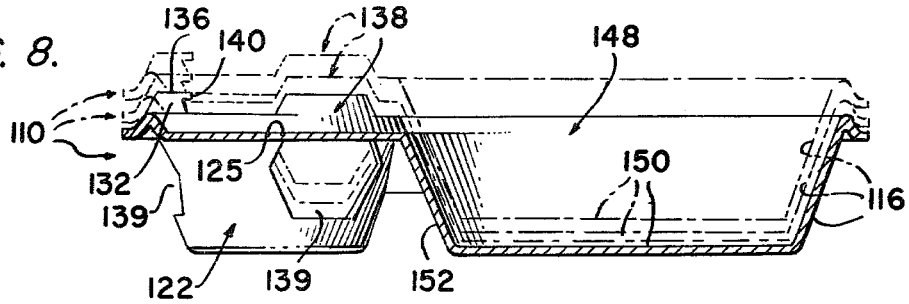
FIG. 8 is a sectional view taken along the plane 8—8 in FIG. 6.
Figure 9:
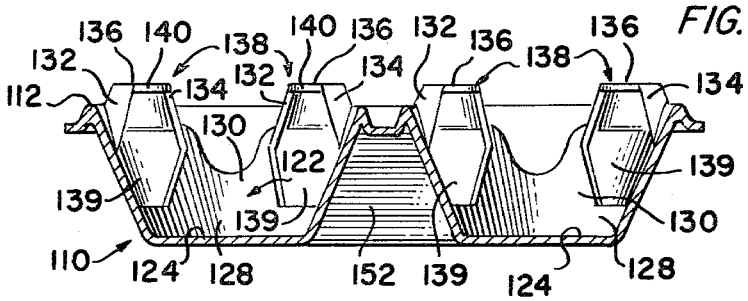
FIG. 9 is a sectional view taken along the plane 9—9 in FIG. 7.
Figure 10:
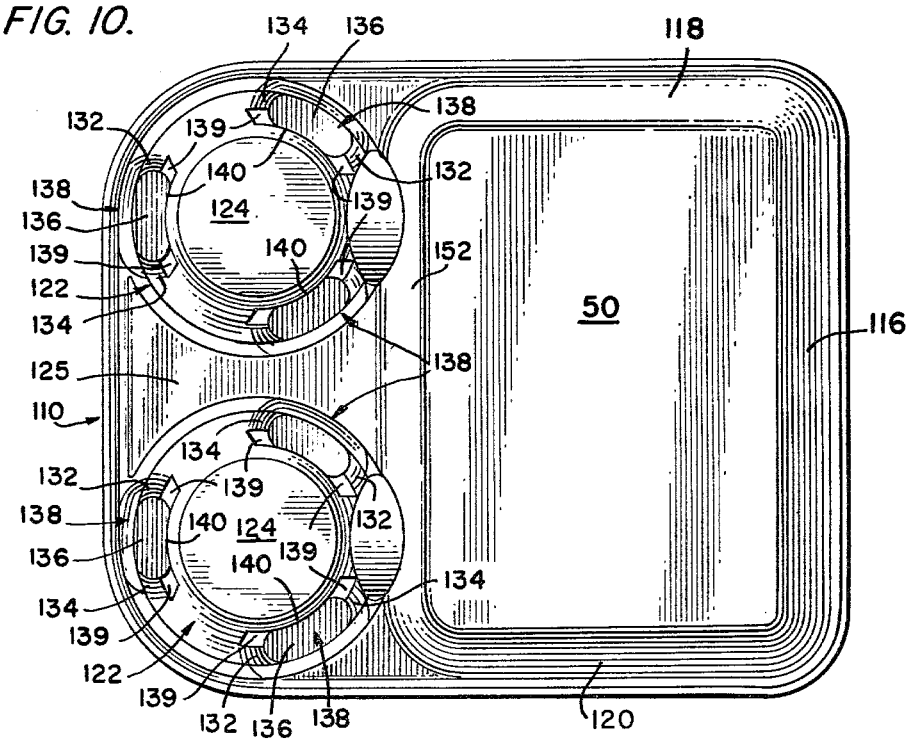
FIG. 10 is a bottom plan view of the tray of FIG. 6.
Figure 11:
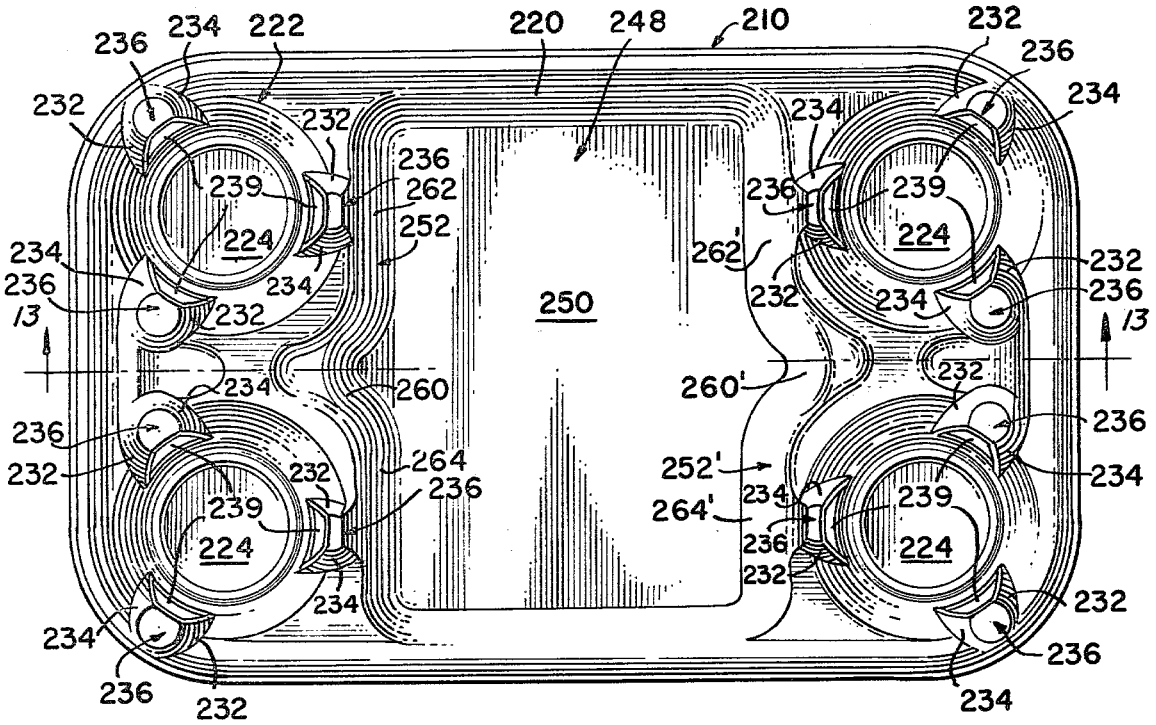
FIG. 11 is a top plan view of a second alternative embodiment of the tray illustrated in FIG. 1.
Figure 12:
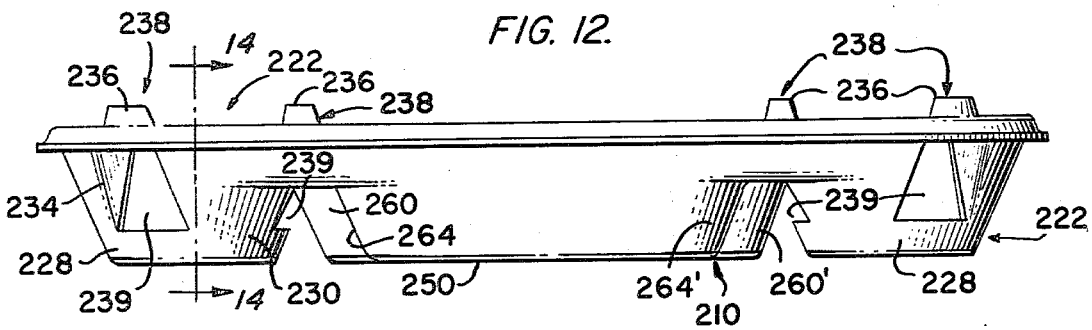
FIG. 12 is a side elevational view of the tray of FIG. 11.
Figure 13:
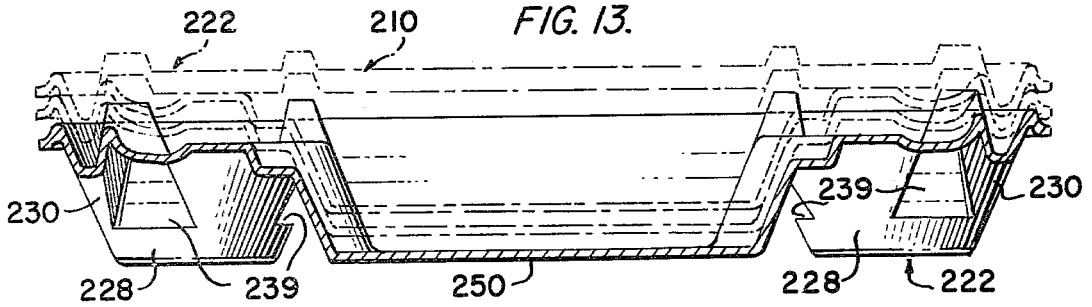
FIG. 13 is a sectional view taken along the plane 13—13 in FIG. 11.
Figure 14:
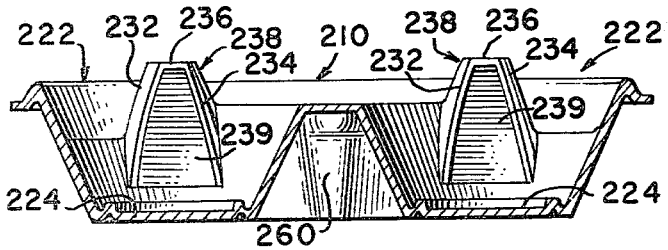
FIG. 14 is a sectional view taken along the plane of 14—14 in FIG. 12.

From the foregoing it may be understood that a tray 10 of molded pulp or like material for carry-out food and beverage is provided with one or more pocket members 22 adapted to receive and firmly support any one of several different size beverage container C normally used in the carry-out food trade, wherein each of the pocket members 22 has a circular floor portion 24; a lower conic web portion 28 extending for a full 360° around the circular floor portion 23 in an area adjacent the circular floor portion 24 and diverging in the upward direction, the lower web portion 28 extending upwardly along a generally conic surface to an upper conic web or surface portion 30 and an upper ridge 12; a plurality of circumferentially spaced apart tower-like members 38 extending radially inwardly of the pocket member 22 from the lower web portion 28 to firmly grip and support a beverage container C which may be small enough in diameter to be initially received in the pocket member 22 but being too large in diameter to reach the circular floor portion 24 to be seated thereon. Each tower-like member 38 of such a pocket member 22 extends upwardly from the lower web portion 28 at an area above the area adjacent the circular floor portion 24 to a level above the upper ridge 12 of the lower web portion 28. Each of the tower-like members 38 also includes a pair of circumferentially spaced radially inwardly extending webs or flanges 32, 34 having integral therewith at upper ends thereof a generally horizontal bridge 36, while the pair of radially inwardly extending webs or flanges 32, 34 and the bridge 36 have radially inner edge 42, 44, 40 which together with the lower web portion 28 define an aperture 39 facilitating stacking a tray 10 havng the pocket members 22 formed therein with like trays 10 in nesting relationship. The radially inner edges 42, 44 of the flanges 32, 34 extend from upper ends thereof at the respective bridges 36 toward the respective lower ends at a steeper angle with the horizontal and closer to the vertical than the lower web portion 28 whereby any beverage container received in the pocket member 22 will upon coming into contact with the radially inner edge 42, 44 of one of the flanges 32, 34 be maintained inwardly of the aperture 39 defined thereby and above the circular floor portion 24 to ensure that any drippage or spillage from a beverage container C will be retained within the floor portion 23 within the enclosure provided by the web portion 28 in the area adjacent the floor portion 24. The floor portion 24 is also seen to include a raised annular rib 46 which is adapted to lie under the bottom of a paper beverage container Cd but within the encircling lip portion L of the cup wall extending below the cup floor, as illustrated in FIGS. 4, 4*d*, and 4*f*. As illustrated in FIG. 4*f*, the beverage container Cd is to be understood to be fully seated in the pocket member 22 with container lip L extending around raised annular rib 46 because the angle of the slant of the side of container Cd together with the diametric dimension of the lower to inermediate portions of container Cd are such that container Cd will pass between the tower-like members 38 without interference or wedging contact in particular from radially inner edges 40, 42, 44. Thus while beverage container Cd will not be frictionally gripped by tower-like members 38, it will at least be braced by tower-like members 38 against being tipped over because of the closeness of radially inner edges 40, 42, 44 of tower-like members 38 which are strategically located in three areas around the inside of pocket member 22.

Figure 1:
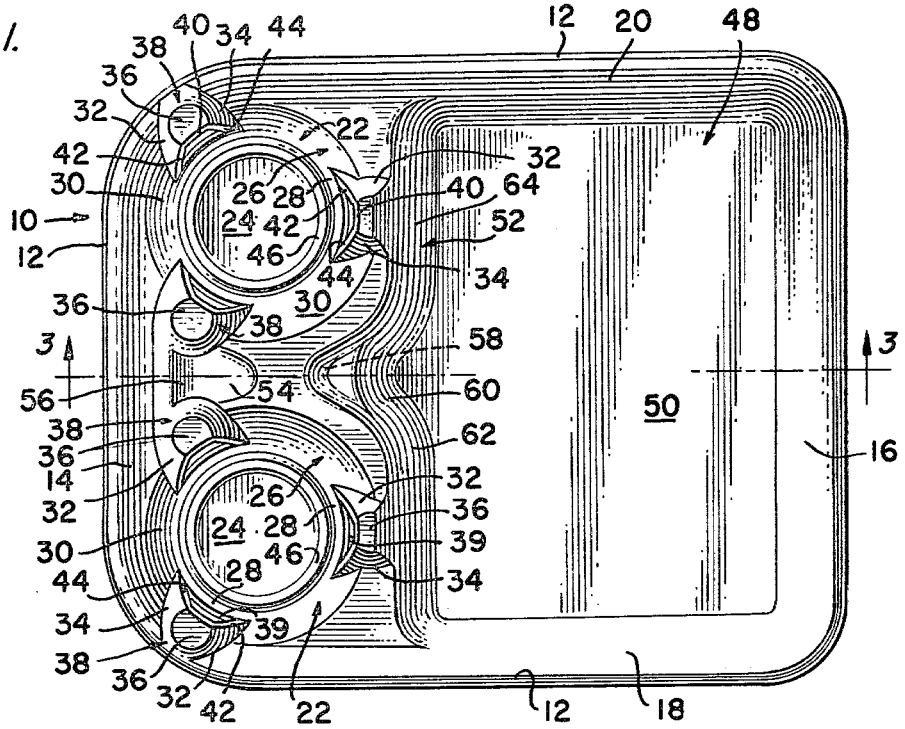
FIG. 1 is a top plan view of one embodiment of the molded pulp tray according to my invention.
Figure 2:
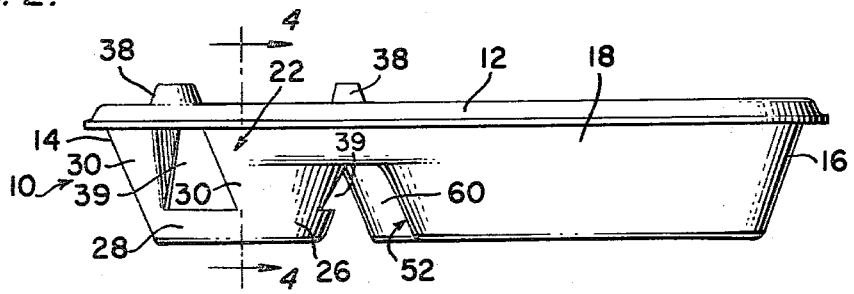
FIG. 2 is a side elevational view of the tray illustrated in FIG. 1.

Beverage containers Ca, Cb, and Cc represent containers, which are larger than container Cd, of which the diametric dimensions adjacent the lower portion and/or the angle of slant thereof are such that containers Ca, Cb, and Cc are too large to reach floor portion 24 even though they are of such size as to initially enter pocket member 22, but before reaching floor portion 24 will come into frictional contact with radially inner edges 40, 42, 44 of two or more tower-like members 38 and will thus frictionally be held within pocket member 22 above floor portion 24 as illustrated in FIG. 4. In FIG. 4*a* the radially inner edges 42, 44 of tower-like members 38 can be seen in frictional contact with the outside of beverage container Ca. In FIG. 4*a* each upper surface portion 30 of pocket member 22 is seen to extend from and connect the inwardly extending radial web 32 of one tower-like member 38 to the inwardly extending radial web 34 of an adjacent tower-like member 38, this will be obvious when FIG. 1 is also considered. The beverage container Cc is also illustrated in FIG. 4*e* wherein the circumferentially extending radially inner edge 40 of at least one tower-like member 30 can be seen to be in frictional contact with container Ca. As is clearly seen in FIG. 4, beverage container Ca extends down to an intermediate level of upper conic surface portions 30 and not down to the level of lower conic surface portion 28. Container Cb, on the other hand, as can be readily seen in FIGS. 4 and 4*e* extends down to the lower edge of apertures 39 where the upper conic surface portions 30 come together with lower conic surface portion 28. As container Cb extends down to the lower edge of apertures 39 where radial inner edges 42, 49 merge with upper conic surface portion 30 and lower conic surface portion 28, radial webs 32, 34 have no apparent thickness or disappear from view in FIG. 4*b*. Beverage container Cc, as illustrated in FIG. 4, extends into pocket member 22 to a level where its side wall will be frictionally engaged with circumferentially extending radially inner edges 40 and at least radially inner edges 42 and/or 44, but before the bottom of container Cc reaches down to the lower edge of apertures 39 and is thus frictionally supported above floor portion 24. Like container Ca, container Cc may be frictionally engaged by radially inner edges 42 and 44 as illustrated in FIG. 4*c*.

As clearly seen in FIG. 1, tray 10 may also include a food compartment 48 in addition to pocket members 22 defined by a bottom 50 in conjunction with wall portions 16, 18, 20 and an intermediate transverse wall 52 integral with and extending from first side wall portion 18 to second side wall portion 20. The tray 10 according to a preferred embodiment of the inventive concept disclosed in FIG. 1 comprises a pair of like pocket members 22 extending along one end of tray 10 in side-by-side relationship with food compartment 48 integral therewith along a common side of the pocket members 22. Radially inner edges 42 and 44 extend at a slant to the vertical and, as may be understood from FIG. 1, converge radially inwardly from upper ends thereof to the respective lower ends.

Tray 10, as seen in FIG. 1, includes on its top side a thumb-receiving horizontal spot 54 and generally vertical thumb abutment 56 between a pair of adjacent tower-like members 38, one each of the pocket members 22. As may be seen in FIG. 5, tray 10 includes on its bottom side a convex protuberance 58. Thus with the index finger tip placed beneath tray 10 and against protuberance 58 and the thumb resting on spot 54 and pressing downwardly back against abutment 56, one may comfortably and yet firmly carry tray 10 with one hand.

Intermediate wall 52 is formed with a deviating section 60 extending out of the plane of portions 62 and 64 on opposite sides thereof and thereby is endowed with protection against torque failure at wall 52 which might otherwise result when heavy food items are placed in compartment 48.

In an alternative embodiment of the inventive concept illustrated in FIGS. 6–10, a tray 110 comprises pocket members 122 having a circular floor portion 124 with a lower conic web surface portion 128 and a plurality of upper conic web surface portions 130 and a plurality of circumferentially spaced tower-like members 138, each having a pair of circumferentially spaced inwardly extending radial webs or flanges 132, 134 and a generally horizontal bridge member 136, which together define apertures 139 facilitating stacking of a plurality of trays 110 in nested relationship. In the instant embodiment of the invention, tray 110 is formed with bridge members 136 having radially inner edges 140 set in closer to the center of the pocket member 122 than radially inner edges of webs or flanges 132, 134 are so that a beverage container inserted in pocket member 122 may come into friction contact with the radially inner edges 140 but not with radially inner edges of webs or flanges 132, 134. Like tray 10, tray 110 also includes a food compartment 148 in addition to pocket members 122 defined by a bottom 150 in conjunction with exterior wall portions 116, 118, 120 and an intermediate transversely extending wall 152 integral with and extending from side wall portion 118 to side wall portion 120 one side of a pair of pocket members 122 which are in side-by-side relationship alongside of intermediate wall 152. Tray 110, like tray 10, is formed with an upper ridge 112 as an extension of the pocket members 122. Also, like upper ridge 12 of tray 10, upper ridge 112 of one pocket member 122 is formed as an extension of the other pocket member 122 and further as may be seen in FIG. 6, extends at least partially around food compartment 148. In tray 110 the radial webs or flanges 132, 134, as may be seen in FIG. 2, extend upwardly from lower ends thereof starting at a substantial distance above circular floor portion 124. The pocket members 122 are joined by a platform portion 125 extending between adjacent tower-like members and subjacent thereto in a manner similar to which pocket members 22 are joined by platform portion 25.

In a second alternative embodiment of the inventive concept, illustrated in FIGS. 11–14, a tray 210 comprises two pairs of pocket members 222 of which each pocket member 222 has a circular floor portion 224 with a lower conic web surface portion 228 and a plurality of upper conic web surface portions 230 and a plurality of circumferentially spaced tower-like members 238, each having a pair of circumferentially spaced inwardly extending radial webs or flanges 232, 234 and a generally horizontal bridge member 236, which together define apertures 239 facilitating stacking of a plurality of trays 210 in nested relationship. In the instant embodiment of the invention tray 210, each pair of beverage container receiving pocket members 222 are arranged generally similarly to the single pair of pockets 22 in the tray 10, except that the two pairs of pocket members 222 are formed at distal sides of a food compartment 248 in mirror image of each other. Food compartment 248 is seen to be defined by a bottom 250 in conjunction with wall portions 218, 220 and intermediate walls 252 and 252'. Walls 252 and 252' each comprise a laterally deviating section 260 and 260', respectively, extending out of plane portions 262,264 and 262', 264'. Tray 210, as illustrated in FIGS. 11–14 is to be understood as to be similar to tray 10, being distinguished from the latter only in that it includes pairs of pocket members 222 on opposite sides of the food compartment 248 instead of merely one pair.

Figure 15:
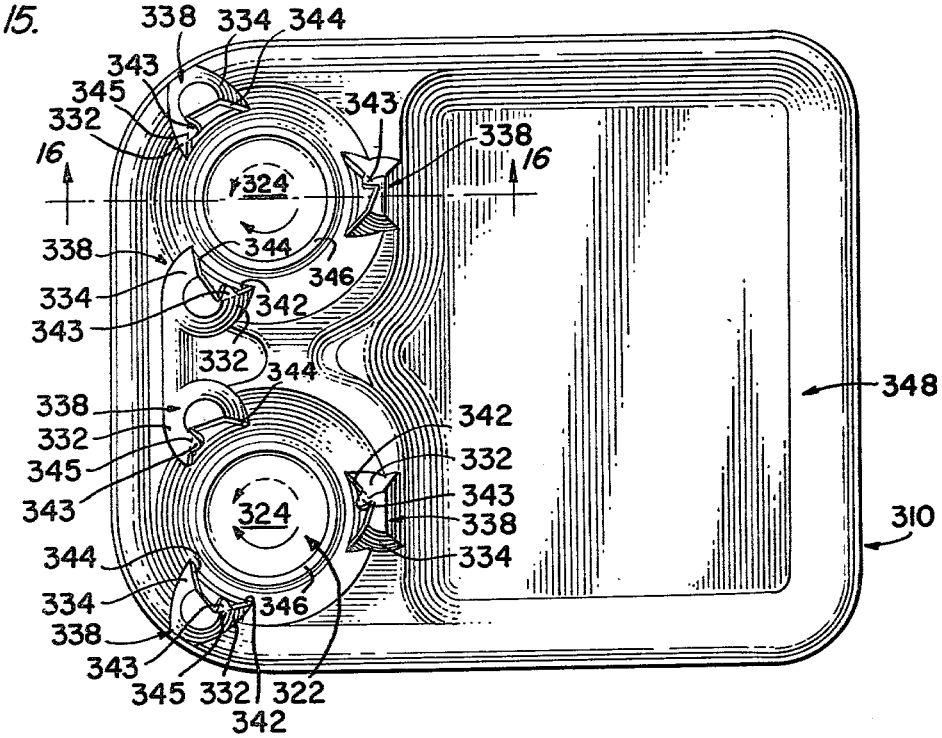
FIG. 15 is a top plan view of a third alternative embodiment of the tray illustrated in FIG. 1.

According to a third alternative embodiment of the disclosed invention, a tray 310, illustrated in FIGS. 15–19 comprises two beverage container receiving pocket members 322 in combination with a food compartment 348 in generally the same manner as elements designated by similar reference numbers reduced by 300 and illustrated in FIGS. 1–5. The tray 310 is distinguished from tray 10 in that in the higher numbered tray 310, each tower-like member 338 comprises one radial flange 332 having a radially inner edge 342 radially outwardly of the radially inner edge 344 of the other radial flange 334. A lug or ear 343 is formed integrally with radial web or flange 332, extending generally in a circumferential direction and inwardly from radially inner edge 342 into pocket member 322. Lugs 343 are preferably formed in the vicinity of the upper end of edge 342 and as may be clearly seen in FIG. 15 all lugs 343 extend from the respective edge 342 in a common direction. Although lugs 343 are shown to be extending from the edges 342 in a clockwise direction, they may alternatively be extending in a counterclockwise direction, it being only necessary that in any one particular pocket member 322 all the lugs 343 extend in a common direction. With the lugs 343 in a pocket member 322 extending in a clockwise as seen in FIG. 15, beverage container inserted into pocket member 322, if it is of such size as to come into contact with tower-like members 338, will come into contact first with lugs 343 which protrude slightly into pocket 322. After initial entry of a beverage container into pocket 322, further or deeper penetration of beverage container and/or removal thereof from pocket member 322 will be facilitated by applying a rotary motion to the beverage container in the direction of the solid arrow appearing in FIG. 15, that is, in the direction in which lugs 343 extend. Lugs 343 are to be slightly yieldable and, if necessary, may include weakened portion or line 345, for example. Rotation of a container in the direction in which lugs 343 extend will provide a firm frictional supporting relationship of the container by lugs 343 with or without further support by inner radial edges 344 of flanges 344. The edges 344 may thus provide secondary frictional support in addition to that initially provided by lugs 343. Because lugs 343 are yieldable, they will accommodate cups of different sizes to hold them against tipping over. Rotation of a container in the direction of the dotted arrows in FIG. 15, that is against the direction in which lugs 343 extend, may tend to break lugs 343 and would be undesirable, except where a larger diameter beverage container than expected is inserted in pocket 322.

Figure 16:
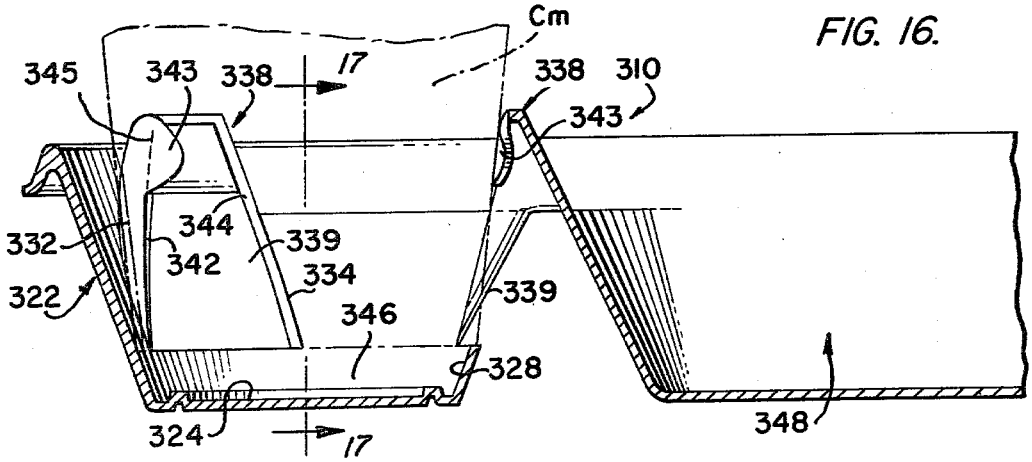
FIG. 16 is a vertical sectional view taken along the plane 16—16 in FIG. 15.
Figure 17:
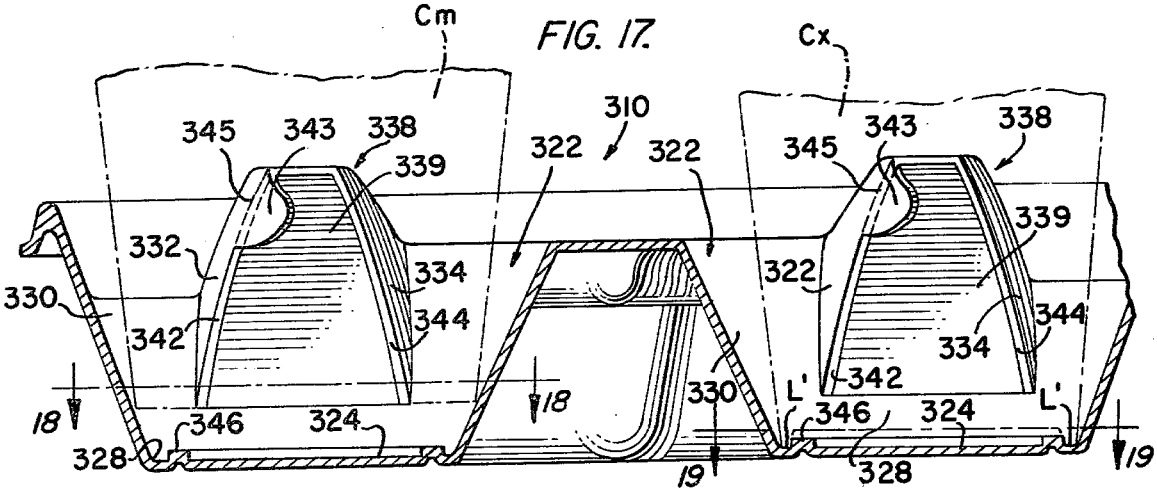
FIG. 17 is a vertical sectional view taken along the plane 17—17 in FIG. 16.
Figure 18:
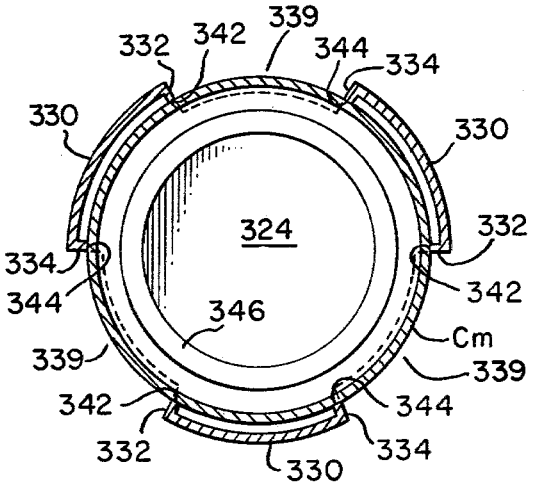
FIG. 18 is a horizontal sectional view taken along the plane 18—18 in FIG. 17.
Figure 19:
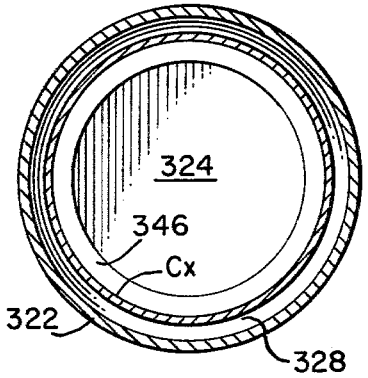
FIG. 19 is a horizontal sectional view taken along the plane 19—19 in FIG. 17.

A beverage container Cm is seen to be supported above floor portion 324 in pocket member 322 by lugs 343 and edges 344 in FIGS. 16 and 17. A beverage container Cx is seen to have penetrated all the way to floor portion 324 in the right pocket member 322 in FIG. 17 so that a raised annular rib 346 will abut against the inside of an annular lip L' formed on the bottom of container Cx and thus may provide stability thereto against being tipped over. Like tray 10, tray 310 is formed with a lower conic web or surface portion 328, a plurality of upper conic web or surface portions 330 and a plurality of apertures 339, which are comparable to similarly numbered elements lowered by 300 in the embodiment of FIGS. 1–5 as mentioned above.

Figure 20:
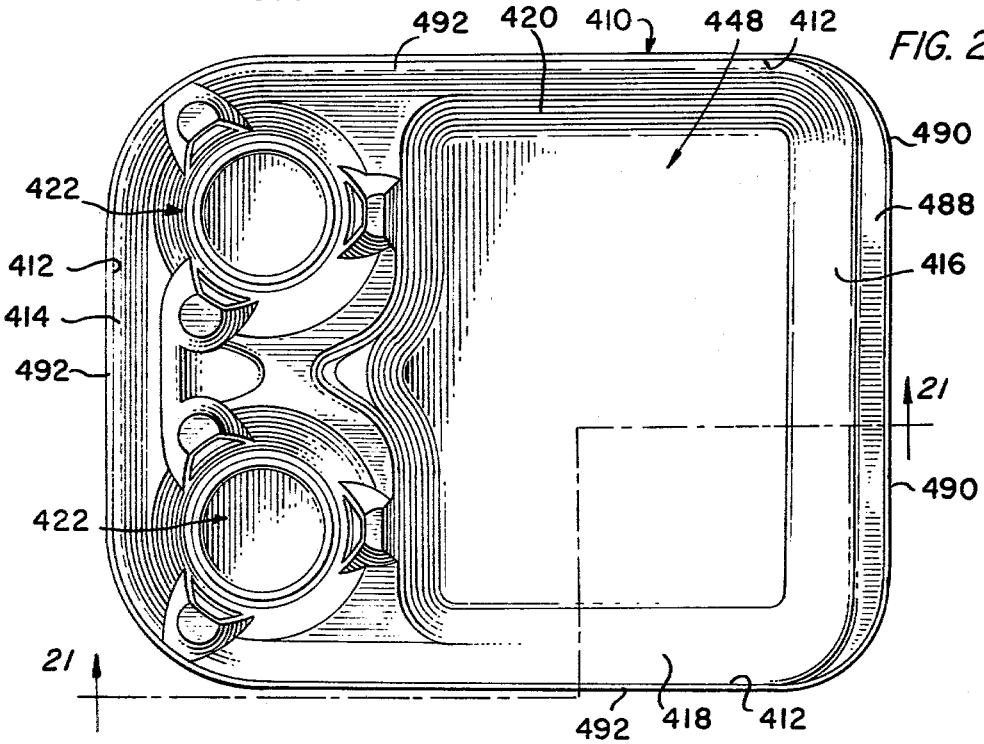
FIG. 20 is a top plan view of a fourth alternative embodiment of the tray illustrated in FIG. 1.
Figure 21:
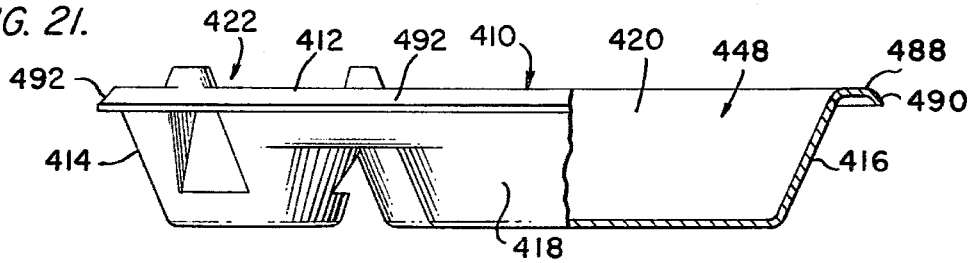
FIG. 21 is a sectional view taken along the multiple sections 21—21 in FIG. 20.
Figure 22:
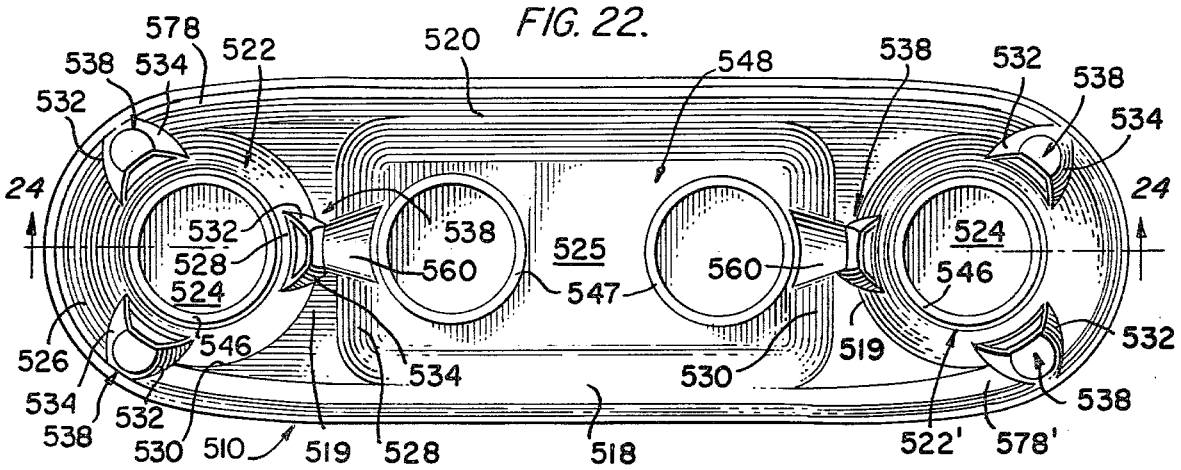
FIG. 22 is a top plan view of yet another alternative embodiment of the tray illustrated in FIG. 1.
Figure 23:
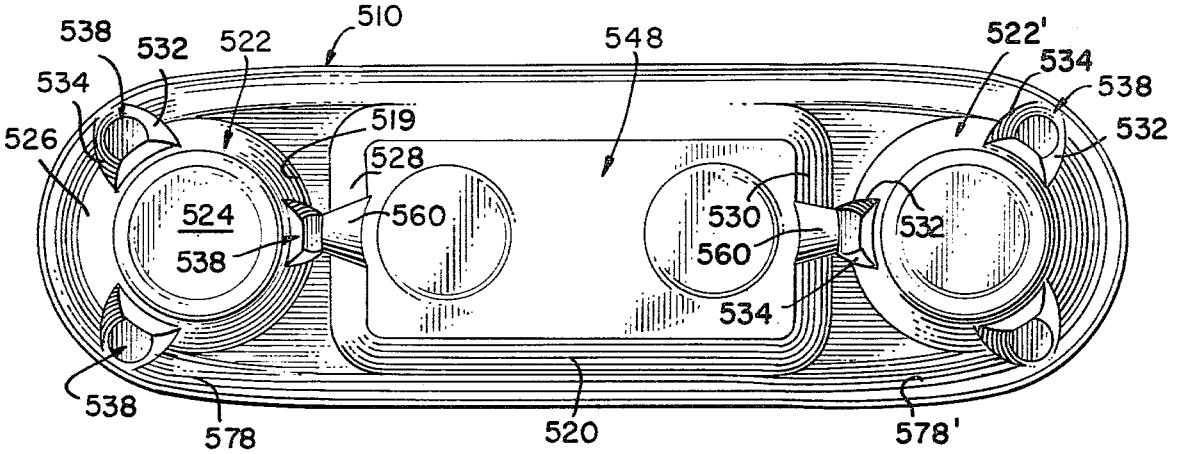
FIG. 23 is a bottom plan view of the tray illustrated in FIG. 22.
Figure 24:
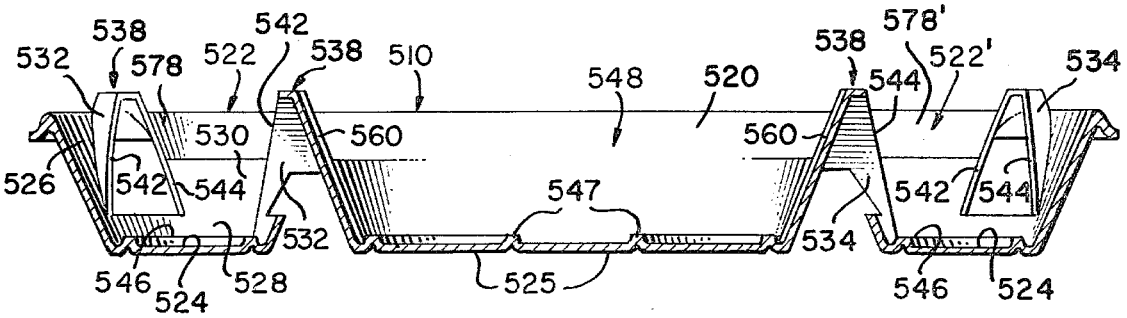
FIG. 24 is a sectional view taken along plane 24—24 in FIG. 22.
Figure 25:
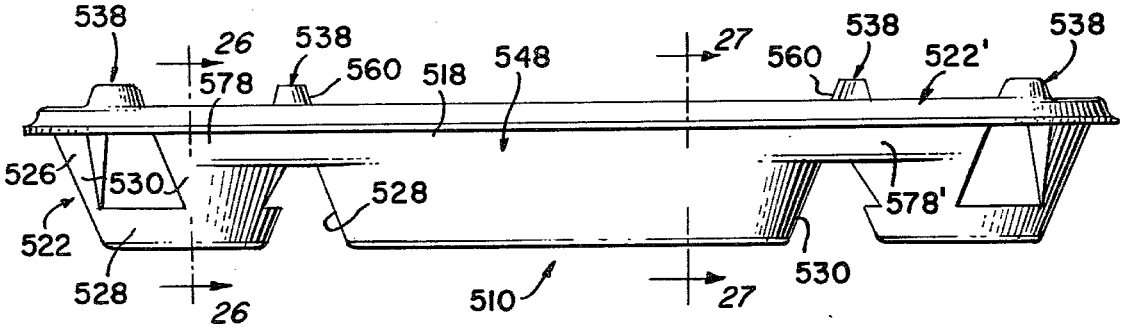
FIG. 25 is a side elevational view of the tray illustrated in FIG. 22.
Figure 26:
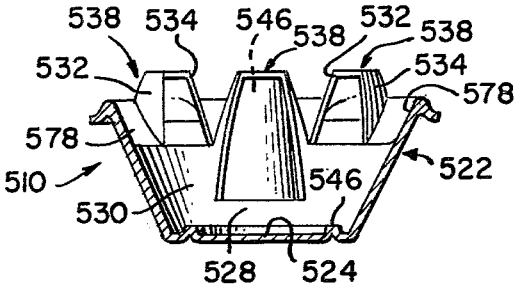
FIG. 26 is a sectional view taken along plane 26—26 in FIG. 25.
Figure 27:
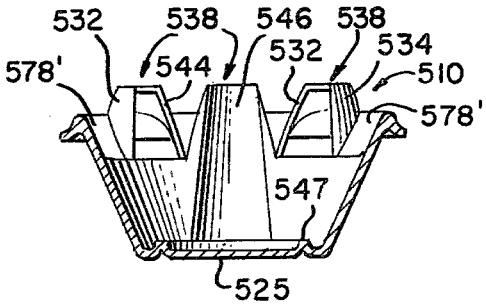
FIG. 27 is a sectional view taken along plane 27—27 in FIG. 25.
Figure 28:
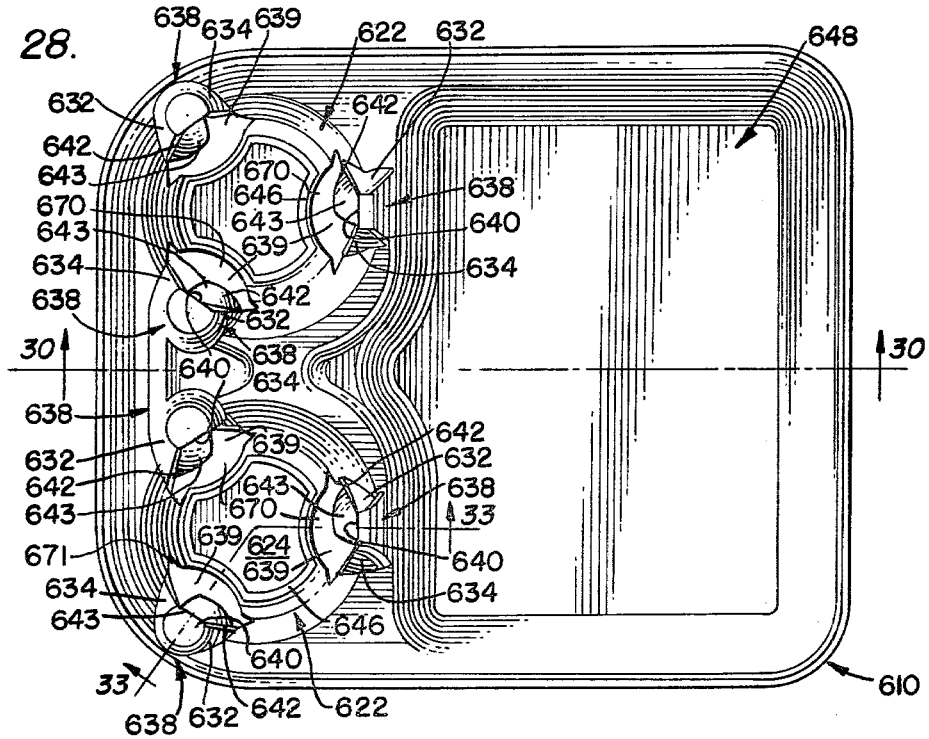
FIG. 28 is a top plan view of another and preferred embodiment of the molded pulp tray according to my invention.
Figure 29:
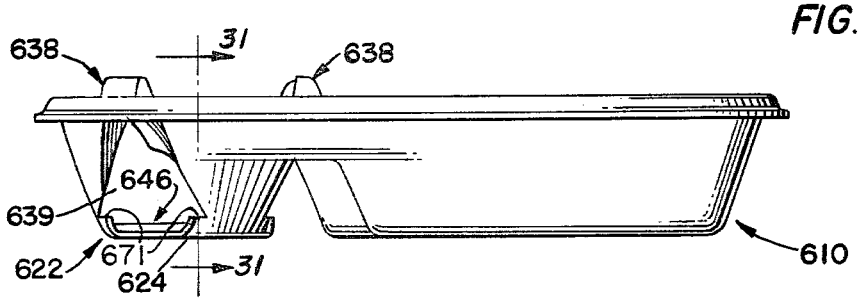
FIG. 29 is a side elevational view of the tray illustrated in FIG. 29.
Figure 30:
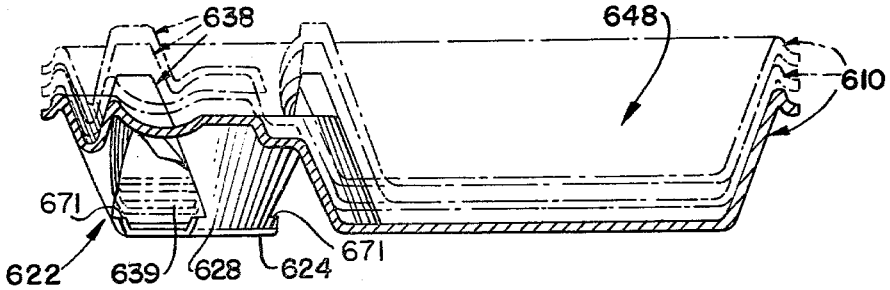
FIG. 30 is a sectional view taken along the plane 30—30 in FIG. 28 with several similar trays in phantom nestably stacked thereon.

According to a fourth alternative embodiment of the disclosed invention, a tray 410, illustrated in FIGS. 20 and 21, comprises two beverage container receiving pocket members 422 in combination with a food compartment 448 in generally the same manner as elements designated by similar reference numbers reduced by 400 and illustrated in FIGS. 1–5. The tray 410 is similar to tray 10 in that in the higher numbered tray 410, pocket members 422 are formed in a row alongside a first end wall portion 414, but may be distinguished from tray 10 in that its second end wall portion 416, which is at the far or distal side of food compartment 448 from pocket members 422, extends outwardly horizontally firstly to provide a widened area 488. Widened horizontal area 488 enhances rigidity of end wall portion 416. At the outer peripheral edge of widened area is a downwardly divergent skirt portion 490 merging with similarly downwardly divergent skirt portion 492 of upper ridge 412 extending from first end wall portion 414 and first and second side wall portions 418 and 420, respectively.

According to still another alternative embodiment of the disclosed invention, a tray 510, illustrated in FIGS. 22–27 comprises a first beverage container receiving pocket member 522 and a second beverage container receiving pocket member 522' in mirror image of each other formed in combination with a food compartment 548 in generally the same manner as elements designated by similar reference numbers reduced by 500 and illustrated in FIGS. 1–5. The tray 510 is similar to tray 10 in that in the higher numbered tray 510, pocket member 522, for example, is of generally conical form and includes a circular floor portion 524 and a conic section 526, a lower conic web surface portion 528 and a plurality of upper conic web surface portions 530. The lower conic surface portion 528 is also integrally formed with and extends upwardly from the floor portion 524 for a full 360° in the immediate vicinity of the floor portion 524 whereby any beverage container which may be received in the pocket member 522 in seated relationship on the floor portion 524 will be surrounded by the lower conic surface portion 528 and further whereby any drippage or spillage from the beverage container received in the pocket member 522 will be retained on the floor portion 524 within the enclosure provided by the lower conic surface portion 528. The upper conic surface portions 530 further are circumferentially spaced from each other and integral with the lower conic surface portion 528 and extend upwardly therefrom.

Pocket member 522 is also similar to pocket member 22 of tray 10 in that it includes similarly structured and arranged tower-like members 538 for providing the same cooperation with beverage containers as tower-like members 38. Pocket member 522' includes the same structural and functional similarities to pocket member 22 as pocket member 522, except that it is in mirror-like image with pocket member 522 as mentioned above. In this respect tray 510 can be compared with tray 210, but comprises only two pocket members 522 and 522' instead of two pairs of pocket members 222 on opposite sides of the food compartment.

In tray 510, pocket member 522 is seen to be formed in combination with compartment 548, which is generally rectangular and has a first wall 528 adjacent to and integral with a side 519 of pocket member 522, and a second wall 530 disposed oppositely from first wall 528. The second pocket member 522' is seen to have a side 519' adjacent to and integral with a second wall 530 of food compartment 548 distal from wall 528. Pocket members 522, 522' and generally rectangular food compartment 548 can be readily seen to be generally in the form of a boat with first and second pocket members 522, 522' being adapted to accommodate beverage containers and generally rectangular compartment being adapted to optionally accommodate a sandwich, a bag of food, or beverage containers. The first and second pocket members 522, 522' each also has a raised annular rib 546 on the respective floor portion 524 thereof to lie under the bottom of a beverage container seated on the floor portion 524 and to be received within a surrounding lip extending below the bottom of such a beverage container. Generally rectangular compartment 548 includes a floor portion 525 having raised annular rib means 547 lying in a single row with the raised annular ribs 546 of pocket members 522 and 522'. Each of the pocket members 522 and 522' is arranged with one of its tower-like members 538 disposed adjacent one of the first and second walls 528 or 530, respectively, of generally rectangular compartment 548. Each of tower-like members 538 disposed adjacent one of walls 528 and 530 has a generally concave surface directed inwardly of compartment 548 to accommodate the sloping side of a beverage container which may be placed in compartment 548. Food compartment 548 is also demarcated by exterior walls 518 and 520 which merge with peripheral walls 578 and 578' of pocket members 522 and 522', respectively. Walls 528 and 530 of compartment 548 also both intersect walls 518 and 520 with rounded corners. As may be seen in FIG. 24, the radially inner edge 542 on web 532 and inner edge 544 on web 534 are inclined radially inwardly of pocket member 522 from top to bottom so that such radially inner edges 542 and 544 of webs 532 and 534 of the tower-like members 538 in each pocket member 522 or 522' will be understood to converge radially inwardly from the respective upper ends toward the lower ends thereof.

According to yet another and preferred alternative embodiment of the disclosed invention, a tray 610, illustrated in FIGS. 28–35 comprises two beverage container receiving pocket members 622 in combination with a food compartment 648 in generally the same manner as elements designated by similar reference numbers reduced by 600 and illustrated in FIGS. 1–5. The tray 610 is distinguished from tray 10 in that in the higher numbered tray 610, each tower-like member 638 comprises a first radial flange 632 having a radially inner edge 642 with a radially inwardly convex protuberance 643 formed integrally with radial web or flange 632, extending radially inwardly from radially inner edge 642 into pocket member 622. Protuberances 643 are formed with a bulbous portion 650 and a tapered, elongate portion 652. Each protuberance 643 is integral at the top of bulbous portion 650 tower-like member 638 in the vicinity of the circumferentially extending radially inner edge 640 as may be clearly seen in FIG. 33. Each protuberance 643 is also seen to extend downwardly from the respective edge 640 in both directions integrally with tower-like member 638 along an integral web hinge 654, which facilitates deflection of bulbous portion 650 along edges 640 and 644 and deflection of tapered portion 652 along edge 642. The protuberances 643 are seen to be situated circumferentially around the interior of pocket members 622. Each protuberance 643 is thus yieldably deflectable radially outwardly of pocket member 622 along the web hinge 654 thereof by the circumference of a beverage container Cy and together the protuberances 643 of a pocket member 622 will frictionally engage such beverage container Cy to hold and stabilize it in pocket member 622. Bulbous portions 650 generally provide initial contact with the container Cy and tapered portions 652 possibly coming into contact with the container Cy, depending upon size and slope of the latter. The protuberances 643 and the web hinges 654 are molded at a lesser basis weight and/or thickness than that of pocket member 622 and the rest of the tray 610. Because of the difference in basis weight of pulp accretion, each protuberance 643 while being of sufficient mass to stabilize a beverage container Cy will at the same time readily deflect radially outwardly along web hinge 654 as a progressively increasing container Cy circumference comes into contact with the protuberance 643. Denesting of each tray 610 from a stack is also facilitated because of the reduced thickness of protuberances 643.

Each protuberance 643 extends integrally with the tower-like member 638, downwardly from both sides of the circumferentially extending radially inner edge 640 at the upper end of the tower-like member 638, to provide a generally closed form without freely projecting elements, which otherwise may tend to get hung up and consequently damaged or broken off when the trays 610 are removed or denested from a stack. The tapered elongate portion 652 extending down one side of a tower-like member 638 functions in the manner of a shoe horn to eliminate catching when individual trays 610 are denested and further functions as an inclined ramp when a beverage container Cy is inserted in pocket member 622 to lead in, guide, and center the beverage container Cy in the pocket member 622.

Due to the inherent resilience of the pulp accretion at the hinge 654 of each of the protuberances 643 of the three tower-like members 638 in a pocket-like member 622, the protuberances 643 when deflected radially outwardly by a beverage container Cy will have a combined centralizing spring-like reaction against the beverage container Cy. At the top of FIG. 35 initial contact between a container Cy and protuberance 643 is made; at the center of FIG. 35 deflection of protuberance 643 is effected by an intermediate size container Cy circumference; at the bottom of FIG. 35 substantial full deflection of protuberance 643 is effected by a large size container Cy circumference.

Figure 31:
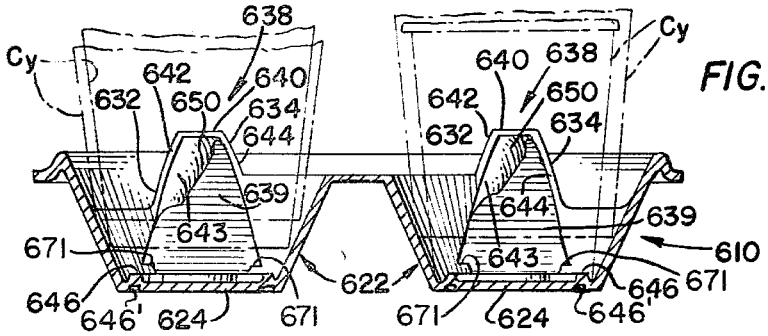
FIG. 31 is a sectional view taken along the plane of 31—31 in FIG. 29.
Figure 32:
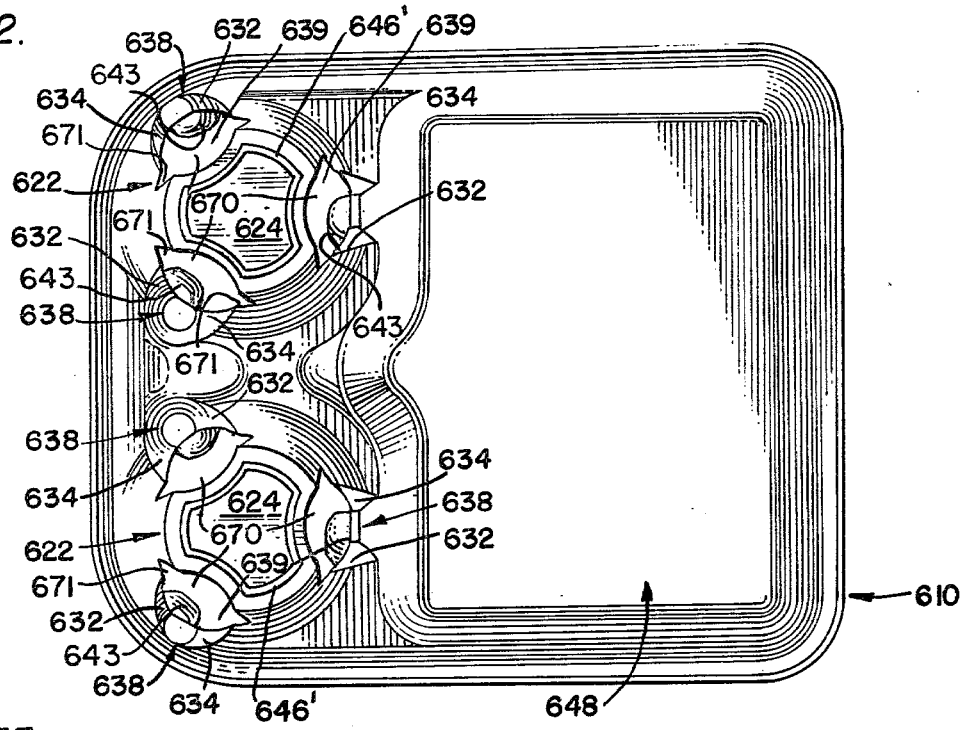
FIG. 32 is a bottom plan view of the tray of FIG. 28.
Figure 33:
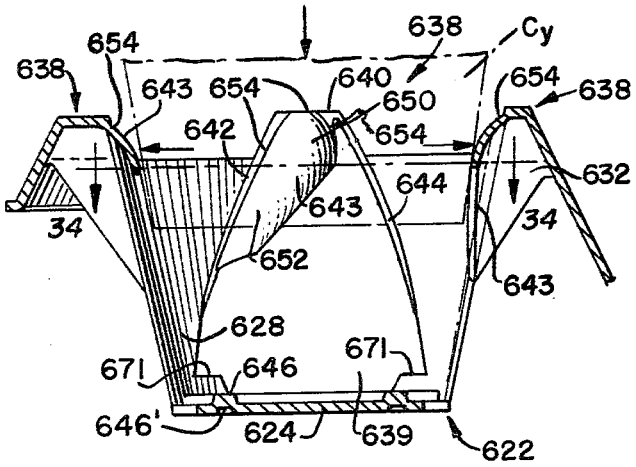
FIG. 33 is an enlarged sectional view taken along the section 33—33 in FIG. 28.
Figure 34:
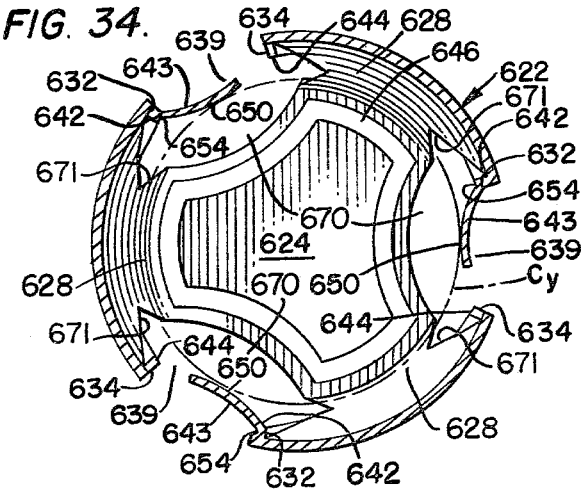
FIG. 34 is a sectional view taken along the plane 34—34 in FIG. 33.
Figure 35:
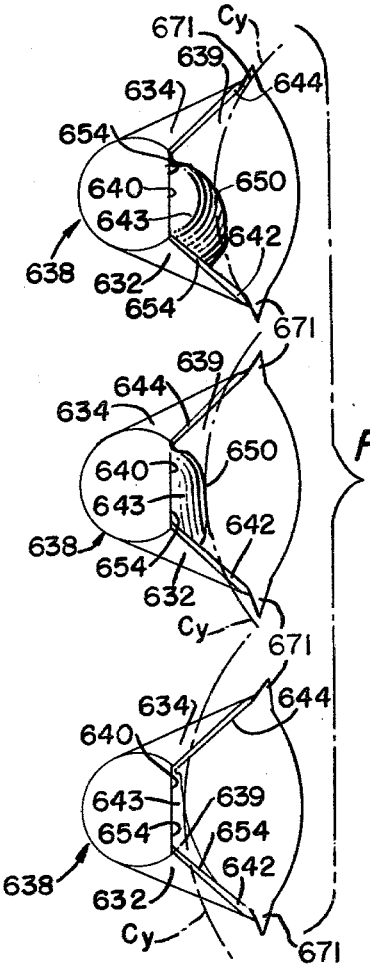
FIG. 35 represents a plan view of progressively increasing radial deflection of a protuberance provided in the tray of FIG. 28 for stabilizing beverage containers as a result of larger container circumferences coming into contact with the protuberance.

Each pocket member 622 of tray 610 is formed with concave clearance opening notches 670 at the bottom floor portion 624 facing and merging into the apertures 639 between the two radial webs 632,634 forming side walls of pocket-like member 622. Floor portion 624 is integral with pocket-like member 622 at the lower edge of conic web surface portions 628. Floor portion 624 is formed with a polylobate or generally cloverleaf raised rib margin 646 adjacent the conic web surface portions 628 and the concave clearance opening notches 670 and which is to be received in the underside of the base of a small beverage container Cy to deter the latter from being tipped over. Raised rib 646 comprises arcuate segments extending alternately adjacent conic surface web portions 628 and adjacent concave notches 670 and specifically is tri-lobate in configuration. As to the concave notches 670 formed in the floor portion 624 of a pocket-like member 622, clearance is provided thereby so that each tray 610 of a stack may be lifted from the stack without interference between the floor portion 624 of one tray 610 and the protuberances 643 of the other tray or trays 610. Each of the apertures 639 have a pair of sharply defined circumferentially-spaced notches 671,671 formed at the lower corners thereof adjacent to and above the level of floor portion 624 as may be seen in FIGS. 29, 31, 33, and 34, for example. An underlying groove 646' may be seen on the underside of floor portion 624 as represented in FIGS. 31, 32, and 33 as a result of the formation of each of the raised ribs 646. The raised ribs 646 which form margin portions in floor portions 624 are thus seen in FIG. 34 to conform to concave notches 670.

It will be obvious to those skilled in the art that various changes may be made without departing from the scope of the invention and therefore the invention is not limited to the several embodiments shown in the drawings and described in the specification but only as indicated in the appended claims.

What is claimed is:

1. A tray for carry-out food and beverage of molded pulp or like material defined by an upper ridge having first and second end wall portions and first and second side wall portions extending downwardly therefrom at a slight inclination inwardly toward the interior of said tray whereby said tray may be readily stacked in nested relationship with similar trays, said tray comprising generally conical pocket means adapted to receive and firmly support any one of several different size beverage containers normally used in the carry-out food trade, said generally conical pocket means being disposed along a first one of said end wall portions and along one or the other of said side wall portions, said conical pocket means having a conic section including a lower conic surface portion and a plurality of upper conic surface portions, said lower conic surface portion extending upwardly and for a full 360° whereby in some instances a beverage container may be received in said pocket means and will be surrounded by said lower conic surface portion and within the enclosure provided by said lower conic surface portions, said upper conic surface portions being circumferentially spaced from each other and integral with said lower conic surface portion and extending upwardly therefrom, each of said upper conic surface portions having circumferentially spaced inwardly extending radial webs integral therewith on opposite sides thereof, said radial webs extending inwardly of said pocket means from the respective upper conic surface portion and upwardly above said ridge, a generally horizontal bridge member extending from one of said radial webs to the next web circumferentially spaced therefrom and integrally joining the two webs to form a tower-like member, said bridge member together with the two radial webs joined thereby, and said conic section defining one of a plurality of apertures which facilitate nesting relationship of said tray with similar trays, but will not permit passage of a cup to be received and firmly held within said pocket means beyond the theoretical conic surface of the upper and lower conic surface portions if lowered to the level of the area of said apertures, each of said bridge members having a circumferentially extending radially inner edge adapted to brace the side wall of a beverage container intermediate the upper and lower ends thereof, and the radial web portions of each of said towerlike members presenting radial inner edges of which at least one is adapted to firmly brace the side wall of a beverage container.

2. A tray as defined in claim 1 wherein said pocket means includes a circular floor portion integral with said lower conic surface portion whereby any drippage or spillage from a beverage container received in said pocket means will be retained on the floor portion.

3. In a carry-out tray 10 one or more pocket members 22 each having a lower conic web portion 28 extending a full 360° and diverging upwardly and an upper conic extension 30 to an upper ridge 12;

a plurality of circumferentially spaced tower-like beverage container gripping members 38 extending radially inwardly of said pocket member 22 and upwardly from the lower end of said upper conic extension 30 to a level above said upper ridge 12 and including a pair of webs or flanges 32,34 radially spaced and inwardly extending and having an integral generally horizontal bridge 36 extending between their upper ends said inwardly extending flanges 32,34 and said bridge 36 having radially inner edges 40,42,44 which together with said web portion 28 define an aperture 39 for facilitating tray stacking, the inner edges 42,44 of said flanges 32,34 being at a steeper angle of the horizontal and closer to the vertical than the surface of said conic web portion 28.

4. A pocket member as defined in claim 3 wherein each of said pocket members has a circular floor portion with said lower conic web portion extending therearound.

5. A pocket member as defined in claim 4 wherein said floor portion includes a raised annular rib which is adapted to lie under the bottom of a paper beverage container but within the encircling portion of the cup wall extending below the cup floor.

6. A pocket member as defined in claim 3 wherein said pocket member in combination with a like pocket member extend along one end of the tray, said pocket members being in side-by-side relationship and having a food compartment integral therewith along one common side of said pocket members.

7. The combination as defined in any one of claims 3, 4, 5 or 6 wherein said radially inner edges converge radially inwardly from upper ends thereof to the respective lower ends, and one of said flanges of each of said tower-like members is disposed slightly outwardly radially of the other of said flange in the same one of said tower-like members.

8. The combination as defined in claim 7 wherein each of said slightly outwardly disposed radial flanges includes a yieldable radially inwardly extending lug adapted to come into engagement with a beverage container when one is inserted in the pocket in which said lug extends.

9. The combination as defined in claim 8 wherein all of said lugs in one of said pockets extend in a common direction when compared with the hand of a clock.

10. The combination as defined in claim 8 wherein all of said lugs in one of said pockets extend in the clockwise direction when viewed from above.

11. The combination as defined in claim 9 wherein each of said lug includes a radially inner face which cooperates with the radially inner edge of the other radial flange of a tower-like member to provide circumferentially spaced-apart contact for each tower-like member with a beverage container.

12. The combination as defined in claim 6 wherein said upper ridge of one of said pocket members is formed as an extension of the upper ridge of the other pocket member and further extends at least partially around said food compartment.

13. The combination as defined in claim 12 wherein said radially inwardly extending flanges extend upwardly at lower ends thereof starting at a location on said web portion a substantial distance above said circular floor portion.

14. The combination as defined in claim 12 wherein said radially inwardly extending flanges extend upwardly at lower ends thereof starting at a location on said web portion adjacent said circular floor portion, said radially inner edges converge radially inwardly from upper ends thereof toward the respective lower ends thereof.

15. The combination as defined in claim 14 wherein said common side along which said food compartment is located includes, as part of said common wall of said pocket members, a lateral deviation from planar wall portions of opposite sides thereof.

16. The combination as defined in claim 15 wherein said pocket members are joined by platform portion extending between adjacent tower-like members and subjacent thereto.

17. The combination as defined in claim 16 wherein said platform includes a first depression on which a person may place his thumb and a second depression providing on abutment on the underside thereof for a finger.

18. The combination as defined in claim 17 wherein said food compartment includes mirror image beverage container structure of said pocket members at its distal side therefrom.

19. The combination as defined in claim 17 wherein said upper ridge extends outwardly from said pocket members and said food compartment downwardly divergently.

20. The combination as defined in claim 19 wherein said upper ridge extends outwardly from said pocket members and said food compartment downwardly divergently except at a far side of said food compartment away from said pocket members where said upper ridge extends outwardly horizontally firstly and then downwardly divergently.

21. The combination as defined in claim 11 wherein each of said lugs includes an upper portion having a downward taper to initiate and effect deflection of said lug radially outwardly upon being contacted by the side of a cup inserted in the pocket member.

22. The combination as defined in claim 21 wherein each of said lugs extends from the slightly outwardly disposed radial flange along a weakened line which facilitates deflection of said lug.

23. A pocket member as defined in either of claims 3 or 4 comprising in combination therewith a generally rectangular compartment having a first wall adjacent to and integral with a side of said pocket member, and a second wall disposed oppositely from said first side, a second pocket member adjacent to and integral with said second wall in mirror image to said first recited pocket member.

24. The combination as defined in claim 23 wherein said first pocket member, said generally rectangular compartment, and said second pocket member together form a generally boat shape tray with said first and second pocket members being adapted to accommodate beverage containers and said generally rectangular compartment being adapted to optionally accommodate a sandwich, a bag of food, or beverage containers, said first and second pocket members each having a raised annular rib on the respective floor portion thereof to lie under the bottom of a beverage container seated on the floor portion and to be received within a surrounding lip extending below the bottom of such a beverage container.

25. The combination as defined in claim 24 wherein said generally rectangular compartment includes a floor portion having a raised annular rib means lying in a single row with said raised annular ribs of said pocket members.

26. The combination as defined in claim 24 wherein one of said tower-like members of each of said pocket members is disposed adjacent one of said first and second sides of said generally rectangular compartment, each of said tower-like members disposed adjacent one of said first and second sides having generally concave surface directed inwardly of said compartment to accommodate the sloping side of a beverage container which may be placed in said compartment.

27. The combination as defined in claim 26 wherein said radially inner edges converge radially inwardly from upper ends thereof toward the respective lower ends thereof.

28. A tray for carry-out food and beverage of molded pulp or like material defined by an upper ridge having first and second end wall portions and first and second side wall portions extending downwardly therefrom at a slight inclination inwardly toward the interior of said tray whereby said tray may be readily stacked in nested relationship with similar trays, said tray comprising generally conical pocket means adapted to receive and firmly support any one of several different size beverage containers normally used in the carry-out food trade, said generally conical pocket means being disposed along a first one of said end wall portions and along one or the other of said side wall portions, said conical pocket means having a floor portion which is at least partially circular and conic section including a plurality of conic surface portions, said surface portions being integral with and extending upwardly from said floor portion in the immediate vicinity of the floor portion whereby any beverage container which may be received in said pocket means in seated relationship on said floor portion will be at least partially surrounded by said conic surface portions, said conic surface portions being circumferentially spaced from each other and having circumferentially spaced inwardly extending radial webs integral therewith on opposite sides thereof, said radial webs extending inwardly of said pocket means from the respective upper conic surface portion and upwardly above said ridge, a generally horizontal bridge member extending from one of said radial webs to the next web circumferentially spaced therefrom and integrally joining the two webs to form a tower-like member, said bridge member together with the two radial webs joined thereby, and said conic sections defining one of a plurality of apertures which facilitate nesting relationship of said tray with similar trays, but will not permit passage of a cup to be received and firmly held within said pocket means beyond the theoretical conic surface of the upper and lower conic surface portions if lowered to the level of the area of said apertures, each of said bridge members having a circumferentially extending radially inner edge adapted to brace the side wall of a beverage container intermediate the upper and lower ends thereof, and the radial web portions of each of said tower-like members presenting radial inner edges of which at least one is adapted to firmly brace the side wall of a beverage container.

29. A tray as defined in claim 28 wherein said radially inner edges converge radially inwardly from upper ends thereof to the respective lower ends.

30. A tray as defined in either of claims 28 or 29 wherein each of said tower-like members includes a radially inwardly convex protuberance extending radially inwardly therefrom for engagement with the side wall of a beverage container, said protuberance having a bulbous portion and a tapered portion extending downwardly from said bulbous portion.

31. A tray as defined in claim 30 wherein said protuberance is integral with the tower-like member along a hinge extending along said bridge member radially inwardly therefrom and downwardly from the two radial webs at inner edges thereof on opposite sides of said bridge member.

32. A tray as defined in claim 31 wherein said hinge extends downwardly at one side of said bridge member joining said tapered portion to one of said radial webs, along said bridge member and downwardly at the other side of said bridge member joining said bulbous portion to said bridge member and the other of said radial webs.

33. A tray as defined in claim 32 wherein said hinge is lesser thickness than the protuberance which it joins with the tower-like member.

34. A tray as defined in any one of claims 28, 29, 30, 31, 32, or 33 wherein the floor portion of said pocket means is formed with a plurality of notched clearance portions each of which communicates with and merges into one of said apertures.

35. A tray as defined in claim 34 wherein said floor portion of said pocket means includes a raised rib of polylobate or generally clover leaf form including arcuate segments extending alternately adjacent said conic surface web portions and said notched clearance portions.

36. A tray for carry-out food and beverage of molded pulp or like material comprising one or more pocket members adapted to receive and firmly support any of several different size beverage containers normally used in the carry-out food trade, each of said pocket members including one or more convex protuberances extending radially inwardly of said pocket member or engagement with the side wall of a beverage container, each of said convex protuberances being of generally lesser thickness than that of the pocket member on which it is formed, each of said convex protuberances also being integral with the pocket member on which it is formed along a web hinge also of lesser thickness than that of the pocket member.

37. A tray having one or more pocket members each having a generally upstanding wall formed with a plurality of circumferentially spaced apertures therein, the bottom or floor of each pocket member being provided with a plurality of concave notched clearance opening portions each of which communicates and merges into one of said apertures, said bottom or floor having a polylobate or generally cloverleaf raised rib having a margin portion conforming to said clearance opening portion.

38. The tray as defined in claim 37 wherein said polylobate rib is tri-lobate.

* * * * *

UNITED STATES PATENT AND TRADEMARK OFFICE

CERTIFICATE OF CORRECTION

PATENT NO. : 4,208,006

DATED : June 17, 1980

INVENTOR(S) : Kenneth D. Bixler, et al

It is certified that error appears in the above—identified patent and that said Letters Patent is hereby corrected as shown below:

The Filing Date should read:

[22] Filed: February 27, 1979

Signed and Sealed this

*Nineteenth* Day of *August 1980*

[SEAL]

*Attest:*

SIDNEY A. DIAMOND

*Attesting Officer*

*Commissioner of Patents and Trademarks*